US005842926A

United States Patent [19]

Rodriguez-Ferre

[11] Patent Number: 5,842,926

[45] Date of Patent: Dec. 1, 1998

[54] MODULAR CONSTRUCTION FOR CHILDREN TO PLAY

[76] Inventor: José Manuel Rodriguez-Ferre, Poligono Industrial Derramador, c/. Albacete s/n, 03440-IBI (Alicante), Spain

[21] Appl. No.: 643,958

[22] Filed: May 7, 1996

[30] Foreign Application Priority Data

May 23, 1995 [ES] Spain ..... 9501383

[51] Int. Cl.[6] ..... A63G 21/02

[52] U.S. Cl. ..... 472/116; 482/35

[58] Field of Search ..... 472/116; 482/35, 482/36; 446/476, 482

[56] References Cited

U.S. PATENT DOCUMENTS 4,893,807 1/1990 Ahrens ..... 472/116
4,943,048 7/1990 Hentges ..... 472/116

*Primary Examiner*—Mickey Yu
*Attorney, Agent, or Firm*—Oblon, Spivak, McClelland, Maier & Neustadt, P.C.

[57] ABSTRACT

A modular construction for children to play. It consists of two side parts (1) forming two ladders, connected at the bottom and top ends by a part (11) forming a seat, and by a roof-like part (7) with a handrail (8), a slide having two sections (13) and (14) extending from such roof to the supporting plane. The invention is applicable for constructions based on modular parts made of a hard plastic material, which include conjugated connectors integrated therein.

8 Claims, 4 Drawing Sheets

MODULAR CONSTRUCTION FOR CHILDREN TO PLAY

The object of the present invention is a modular construction for children to play, having the arrangement and characteristics described hereinafter.

BACKGROUND OF THE INVENTION

Various constructions are presently known destined for children to play and consisting of a plurality of modular parts made of a hard moulded plastic material, for instance the structure described in Spanish Patent number 9202609, the holder of which is the very holder of this application. Said Patent uses various parts made of a moulded material having means interconnecting the parts consisting of fitting, slipping, socketing or other systems, excluding traditional means independent of said parts, for instance bolts, nails and the like. The object of the subject Patent was to provide a structure to form constructions for children to play that could be easily mounted and taken apart by an adult who was not skilled in the art.

One of the main characteristics of Spanish Patent number 9202609 lay in upwardly rectangular shaped modular parts having short extensions of material projecting on a different plane horizontally from their vertical sides and being curved in opposite directions to jointly define longitudinal guides, suitable to axially receive two edges having a round section or a section suited to the guide, thereby to obtain a slipping-assembly of the parts.

SUMMARY OF THE INVENTION

The object of the present invention includes the means of assembly covered by the priority Patent, which are provided with a specific shape and structure in order to establish connections between modular wood-like parts and modular tree-like parts making up the sides of a construction for children to play that altogether stands as a small wooden house or hut, with a roof and handrail that can be reached up steps integrated in the sides. One of the sides of the roof, opposite that of the handrail, supports the raised end of a sectional slide whose lower end is supported on the ground, and the middle portion of which includes a cross pin connecting both sections, and joined at one end to the side tree-like modules. The tree tops have cavities where fruit-like detachable parts are received. The construction further includes a swinging bench and a reversible table that may be variously used, thereby for the playing possibilities to be extended.

In order to fully describe the invention and allow the formal and structural characteristics thereof to be easily understood, sheets of drawings are attached to this specification showing a modular construction for children to play in accordance with the object of the invention.

DESCRIPTION OF A PREFERRED EMBODIMENT OF THE INVENTION

In order to clearly show the construction subject of the present invention, its several constituent parts and the mounting stages thereof are described hereinafter with reference to the drawings, which show a preferred embodiment for informative purposes and should therefore be construed in the broadest sense and not to limit the scope of the invention.

Figure 7:
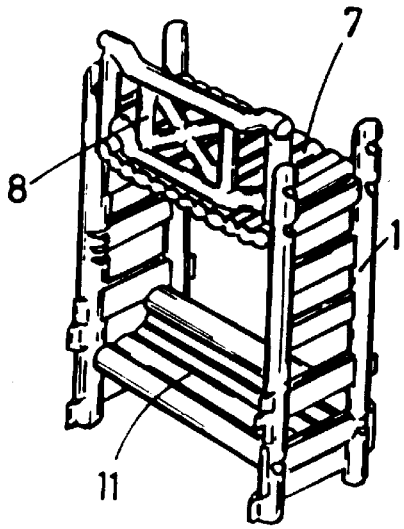
Figure 8:
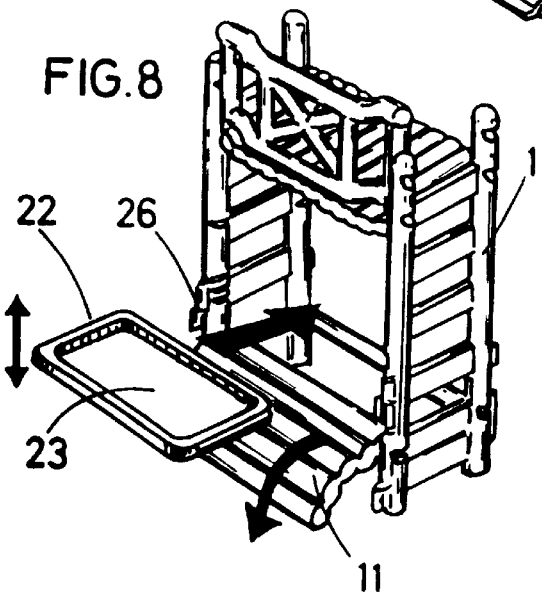
Figure 10B:
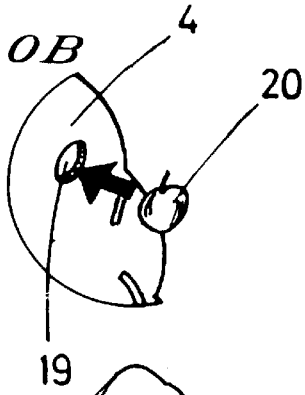
Figure 10A:
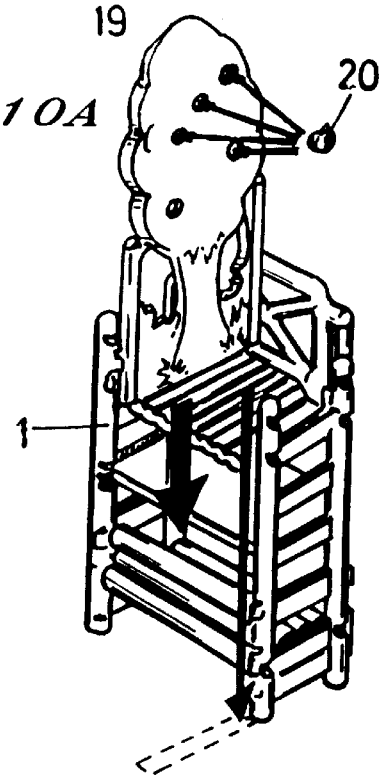
Figure 9:
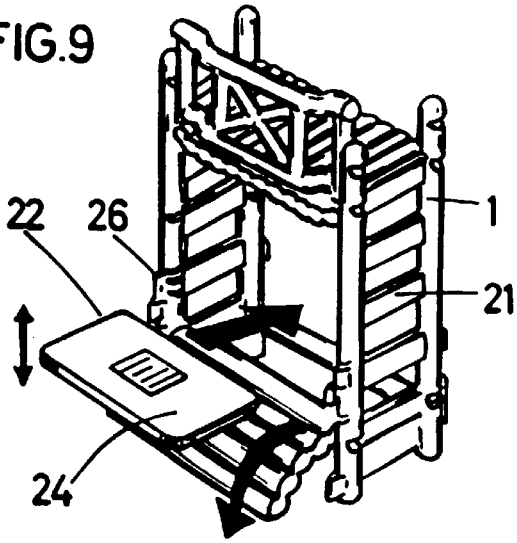
Figure 12A:
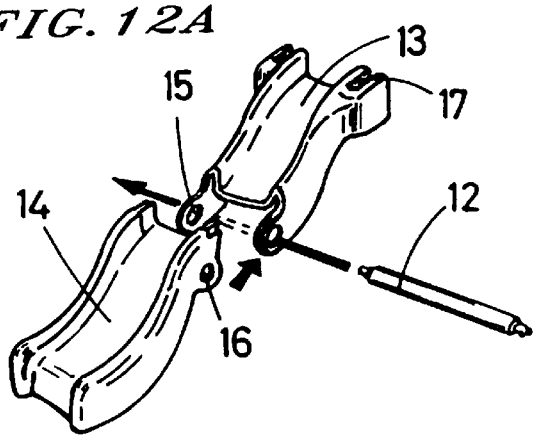
Figure 12B:
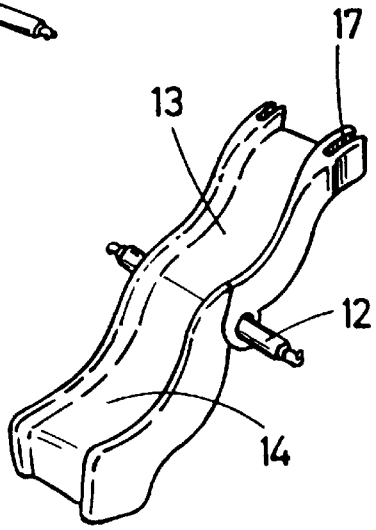
Figure 12C:
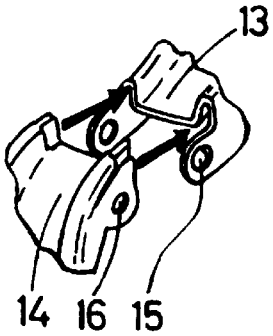
Figure 11:
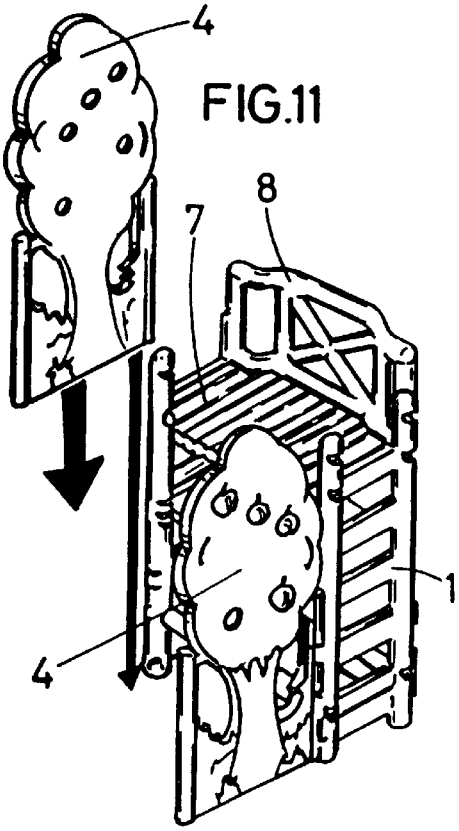
Figure 13:
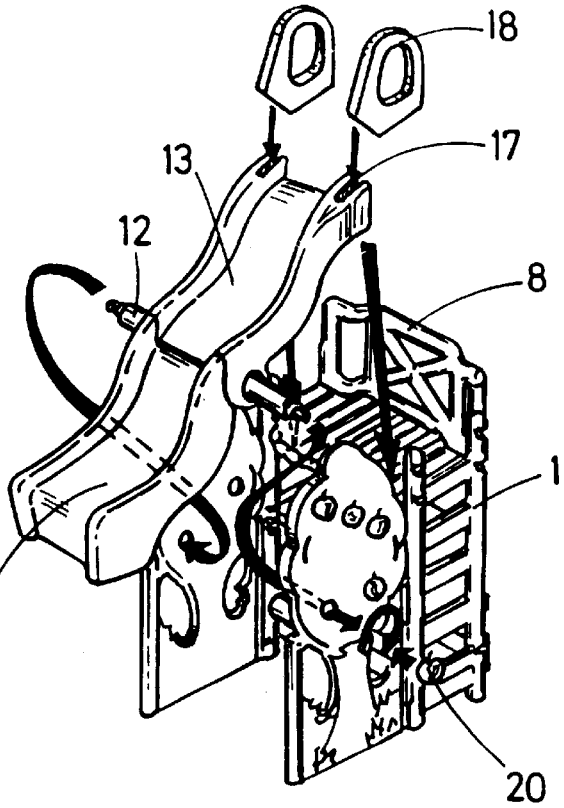

In FIG. 1, where a breakdown of the constituent elements of the construction is shown, one of the side parts of the construction is numbered -1-, two of such parts -1- being provided, being log-like in shape and having pairs of extensions of material, numbered -2-, of the kind covered by Spanish Patent number 9202609, on two opposite longitudinal sides, which establish guides for edges -3- that have a round section and are also covered by said priority Patent, provided in flat tree-like parts -4- of which there are two. Both parts -1- and -4- are assembled in coplanar arrangement, as shown in FIGS. 11 and 13, parts -1- including female holes -5- destined to receive male salients -6- provided in other parts, for a socketing and turning type assembly. These male parts -6- are provided in a log roof-like rectangular part -7- and also in a part -8- making up a handrail, that is also of log-like construction. This part -8- has a lower central projection -9- that fits in a notching -10- of part -7-. Other holes, similar to -5-, lying at the lower end of the upright members of parts -1-, receive spigots -6- existing in a transversely curved rectangular part -11- serving as a seat that swings about the virtual axis defined by such holes and spigots, as shown in FIGS. 7, 8 and 9.

Figure 1A:
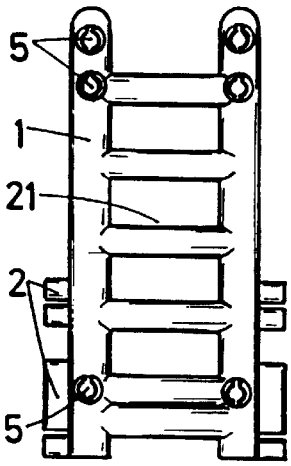
FIG. 1 shows the various parts altogether making up the construction.
Figure 1B:
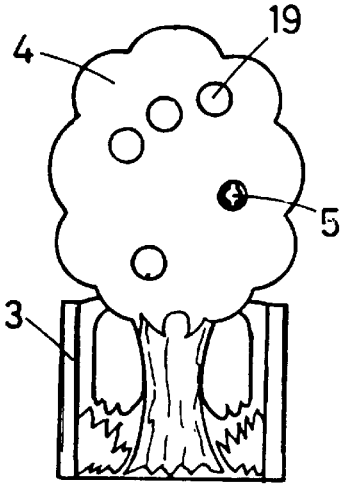
Figure 1C:
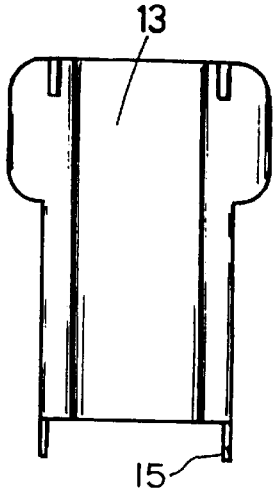
Figure 1D:
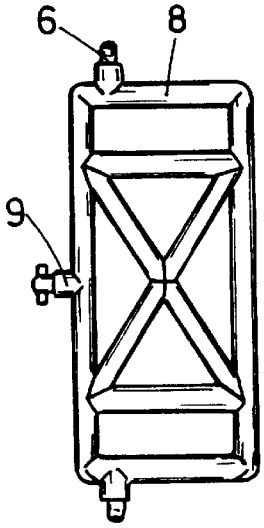
Figure 1E:
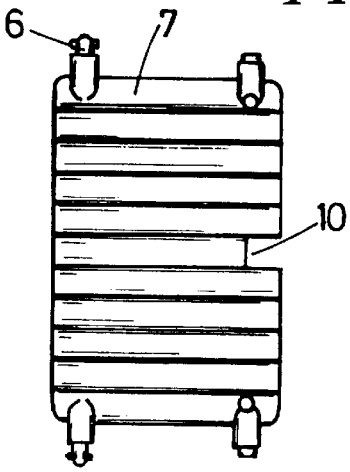
Figure 1F:
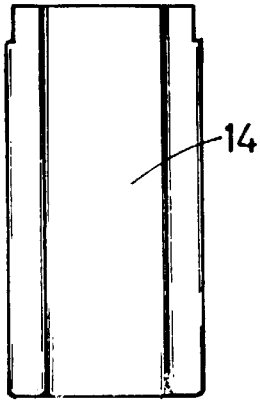
Figure 1G:
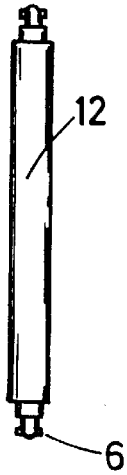
Figure 1H:
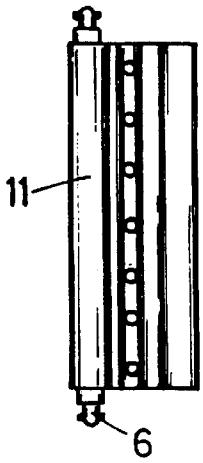
Figure 1I:
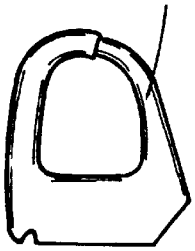
Figure 1J:
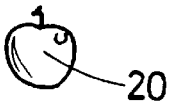
Figure 1K:
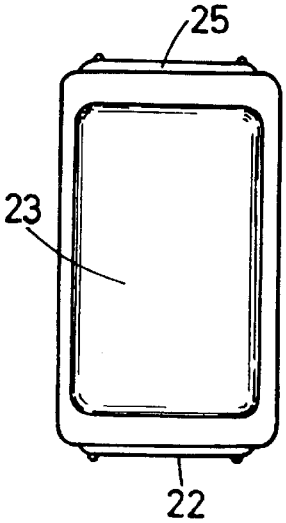
Figure 2:
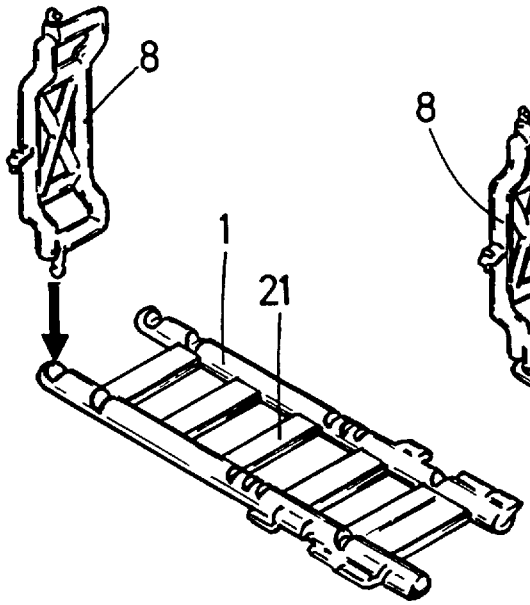
FIGS. 2 to 13 illustrate the successive mounting stages of the parts leading to the construction being formed.
Figure 3:
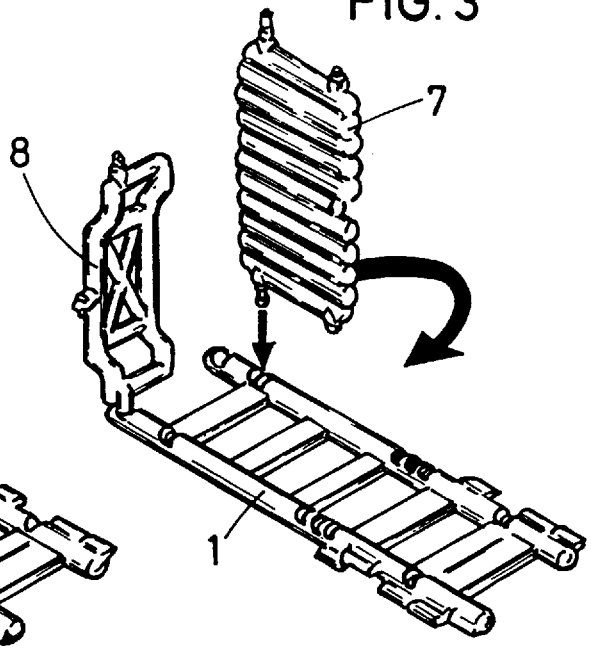
Figure 4:
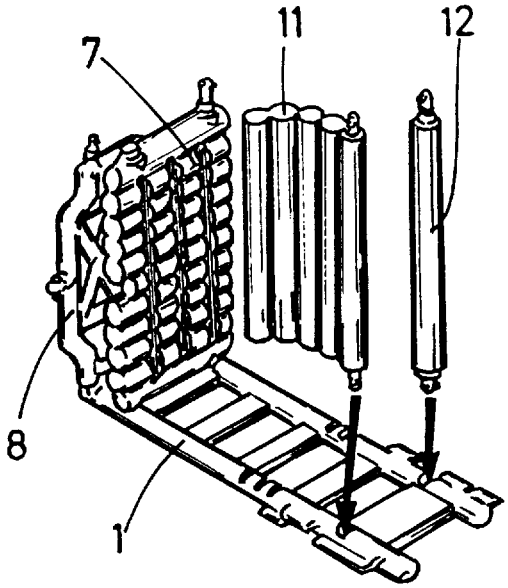
Figure 5:
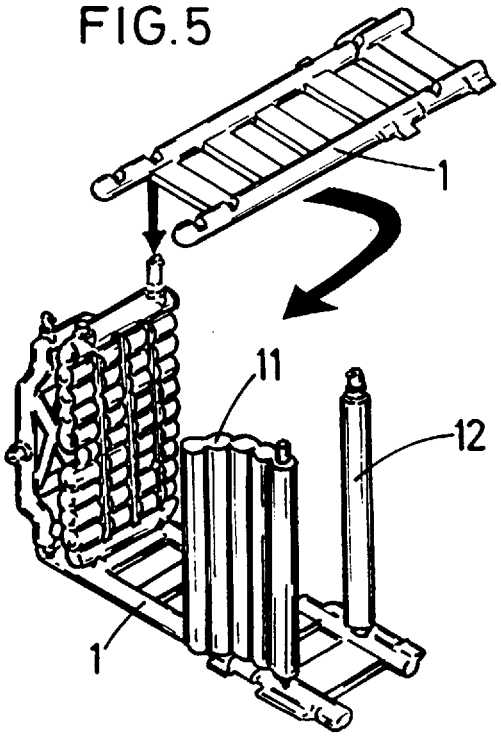
Figure 6:
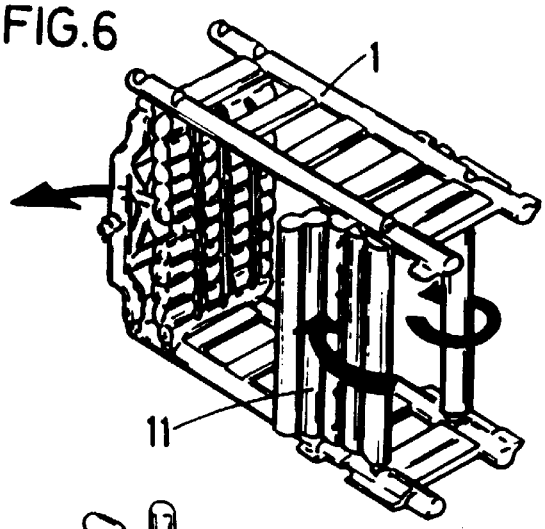

A roller -12-, of which there are two, has spigots, similar to -6-, at its ends. One of the rollers provides a transverse connection between parts -1-, as shown in FIGS. 5 and 6, whereas the other twin roller serves as a pin, connecting sections -13- and -14- forming a slide, the sections having perforated tabs -15- and -16- to such end. The ends of the pin -12- are supported by side parts -4-. The top end of the slide is supported on the front side of the roof part -7-, which includes notchings for a stable positioning thereof, whereas the lower end of the slide is supported directly on the ground.

The top end of the slide has incuts -17- for grip parts -18- to be fitted.

The tree-like parts -4- are provided with cavities 19- on their tree top-like upper ends to house fruit-like semi-spherical bodies -20-.

Parts -1- have cross members -21- serving as ladder steps allowing the roof -7- to be reached on either side of the construction. The upright members of such parts -1- have slots -26- to guide a rectangular plate -22- that is in turn provided with counter-guides -25-, thereby making the slip-type connection between such parts -1- easier. The plate -22- is of the reversible kind, one of its faces -24- being flat and serving as a table, and the other one having a rectangular recess -23- which becomes a playing cavity-sandpit.

I claim:

1. A modular construction comprising:

first and second rectangular side members, wherein each side member includes first and second upright members which have round portions, said round portions of each of said first and second upright members being joined by a plurality of cross members in the form of staircase steps;

at least a first elongated part having a first and second end, said first end of said elongated part connected to a bottom end of said first upright member of said first side member at a connection and said second end of said elongated part connected to a bottom end of said first upright member of said second side member at a connection, wherein said elongated part has a round portion and wherein said elongated part is perpendicular to said side members when joining said upright members; and a transversely curved rectangular part having a first and second end, said first end of said rectangular part connected to said second upright member of said first side member at a connection and said second end of said rectangular part connected to said second upright member of said second side member at a connection, wherein said transversely curved rectangular part rotates between a first position and a second position, wherein said curved rectangular part forms a concave seat with a backrest when in the first position and said curved rectangular part forms a convex seat having no backrest when in the second position;

wherein said connections are integrated conjugated connectors that operate by at least one of fitting, slipping and socketing.

2. A modular construction for children to play, as claimed in claim 1, further comprising:

a horizontal rectangular part connected perpendicularly to upper ends of said first and second side members with connections; and a lattice part connected perpendicularly to said horizontal rectangular part with connections, thereby forming a handrail.

3. A modular construction for children to play, as claimed in claim 7, further comprising:

a first and a second tree module, said first and second tree modules being planar and having a silhouette in the shape of a tree, wherein said first and second tree modules are respectively connected coplanar to said first and second side members, each said tree module including at least one fruit cavity at an upper end of said tree module and each tree module including a slide support cavity;

a plurality of fruit modules which communicate with said fruit cavity;

a slide support member; and a top slide member and a bottom slide member connected at perforated tabs formed in said top and bottom members, said top slide member connected to said horizontal rectangular part, and said bottom member contacting the ground, said tabs include tab cavities that receive said slide support member, wherein slide support member connects to the slide support cavities and passes centrally through said tab cavities.

4. A modular construction for children to play, as claimed in claim 1, further comprising:

a plurality of grips;

wherein said top slide member further comprises a plurality of incuts which releasably connect with said grip parts.

5. A modular construction for children to play, as claimed in claim 1, further comprising:

a rectangular plate with a first planar side and a second concave side, said plate including counter guides;

wherein said upright members include slots for cooperating with said counter guides which releasably connect with said counter guides.

6. A modular construction for children to play, as claimed in claim 2, further comprising:

a rectangular plate with a first planar side and a second concave side, said plate including counter guides;

wherein said upright members include slots for cooperating with said counter guides which releasably connect with said counter guides.

7. A modular construction for children to play, as claimed in claim 6, wherein said first planar side of said rectangular plate is in the shape of a table top and said second side of said rectangular plate is in the shape of a box-sandpit.

8. A modular construction for children to play, as claimed in claim 4, further comprising:

a rectangular plate with a first planar side and a second concave side, said plate including counter guides;

wherein said upright members include slots for cooperating with said counter guides which releasably connect with said counter guides.

* * * * *